US006021783A

United States Patent [19]

Phillips

[11] Patent Number: 6,021,783

[45] Date of Patent: Feb. 8, 2000

[54] BRAID REMOVAL TOOL

[75] Inventor: Alton Hugh Phillips, Mountain View, Calif.

[73] Assignee: Alton H. Phillips, Mountain View, Calif.

[21] Appl. No.: 09/234,287

[22] Filed: Jan. 20, 1999

[51] Int. Cl.[7] ..... A45D 24/00; A45D 7/02

[52] U.S. Cl. ..... 132/200; 132/148; 132/219; 132/212

[58] Field of Search ..... 132/200, 148, 132/150, 121, 123, 219, 106, 213.1, 212

[56] References Cited

U.S. PATENT DOCUMENTS 4,766,914 8/1988 Briggs .
5,701,920 12/1997 Taylor .
5,722,575 3/1998 Smith .

*Primary Examiner*—John J. Wilson
*Assistant Examiner*—Robyn K Doan

[57] ABSTRACT

A braid removal tool has a comb, a strap, and a plurality of prongs. The strap is used to fasten the comb to a user's thumb. To remove a section of braids, a user first engages prongs with braids by grasping a section of unbraided hair between an index finger and the comb. Once the prongs are engaged with braids, use a downward motion and comb braids toward a hair end. Repeat this procedure until braids are completely removed. The tool may be worn on the thumb of a second hand to assist the second hand in grasping the braids to prevent excessive pulling on a scalp during combing.

18 Claims, 8 Drawing Sheets

BRAID REMOVAL TOOL

BACKGROUND—FIELD OF INVENTION

This invention relates to tools and devices used to remove braids from hair, rope, and other strands of intertwined material. Specifically, the present invention relates to an improved comb for manually removing braids from hair.

BACKGROUND—PRIOR ART

Braided hairstyles have existed for several centuries and are becoming increasingly popular today. For individual braids, the hair is braided into 200–1000 braids. While the multiplicity of braids creates the desired style, removing the braids can be time-consuming. The smaller the braids, the more time is required to remove them. For example, two to four hours are typically required for medium-sized braids, while four to six hours are required for small braids.

Individuals who debraid hair for others typically use a fine-tooth comb to remove braids. The comb can be used to remove multiple sections of braids simultaneously. Moreover, after the braids are removed, less work is required to comb out remaining knots and tangles in the hair. Despite these time saving benefits, the comb has some major disadvantages in the braid removal process. It is difficult for many individuals to grasp the braids with one hand while maneuvering the comb with the other hand to engage the comb with the braids. The braids must also be firmly grasped to prevent excessive pulling on the scalp by the combing action. This grasping action causes fatigue in the fingers and increases the risk of accidentally pulling on the scalp during combing. This risk is exacerbated when the braids are small and when multiple braids are grasped simultaneously.

Several professional hair-braiding salons do not offer braid removal services, and the cost to the client for such services can be prohibitive. Therefore, many individuals opt to remove their own braids without the aid of an assistant. In this case, the process becomes more time-consuming and tedious because the individual must remove a majority of the braids without sight of the tool and the braids. Because sight of the braids is limited, the individuals are more dependent on tactile sensing. For this reason, the fingers are the most popular tools among individuals who debraid their own hair. To reduce the risk of pulling on the scalp many individuals opt to comb using less force, consequently removing the braids at a slower rate.

However, when an individual employs his/her fingertips to remove braids, only one braid can be worked on at a time. Additionally, cramps and numbness typically develop in the fingers and longer fingernails can be damaged in the removal process. Once the braids are removed, additional time must be spent to comb out the remaining knots and tangles in the hair.

U.S. Pat. No. 5,701,920 to Taylor et al. (1997) has been proposed to address some of the aforementioned problems but suffers from a number of disadvantages:

(a) Only one braid can be worked on at a time.
(b) Use of two hands is required to engage the tool with the braid. One hand is needed to steady the braid and the other to maneuver the tool.
(c) The tool cannot be used easily by an individual removing his/her braids because sight of the tool and braid is required for easily engaging the tool with the braid.
(d) Additional combing is required after the braids are removed to remove remaining knots and tangles in the hair.
(e) Fatigue in the hand grasping the braid increasing the risk of pulling on the scalp.

A hand-mounted brush (having the brand name VALDEN, produced by the Sally Beauty Supply Company in the U.S.A.), although not designed for removing braids, would be ineffective in the braid removal process for the following reasons:

(a) The bristles are too soft to effectively penetrate the braid.
(b) There are too many bristles easily entangling the hair.
(c) The brush, not fully constrained to the hand, can slip off the hand during brushing.

Hence, there is a need in the art for a safe, inexpensive, fast, easy-to-use device for the manual removal of braided hair which can be used by individuals to remove braids from their own hair or from the hair of others.

OBJECTS AND ADVANTAGES

Accordingly, several objects and advantages of the present invention are:

a) a tool which can be used to remove multiple braids simultaneously;
b) a tool which requires the use of only one hand to engage the tool and braids;
c) a tool which can easily be used by an individual to remove his/her own braids without sight of the tool and braids;
d) a tool which will eliminate numbness and cramps in the fingers and will eliminate damage to fingernails;
e) a tool which requires less post braid removal combing;
f) a tool that will reduce the typical time required for removing braids; and
g) a tool that will reduce fatigue in the hand grasping the braid reducing the risk of pulling on the scalp.

Further objects and advantages of my invention will become apparent from a consideration of the drawings and ensuing description.

REFERENCE NUMERALS IN DRAWINGS

| | | | |
|---|---|---|---|
| 4 | BRAID REMOVAL TOOL | 22 | HOOK MATERIAL |
| 4C | BRAID REMOVAL TOOL | 22C | HOOK MATERIAL |
| 6 | COMB | 24 | LOOP MATERIAL |
| 6A | PARITIONED COMB | 24C | LOOP MATERIAL |
| 6C | COMB | 26 | FLAP |
| 8 | STRAP | 26C | FLAP |
| 10 | TAB | 28 | PAIR OF KNUCKLES |
| 10A | PRONG PARTITION TAB | 30 | THUMB |
| 10B | GAP PARTITION TAB | 32 | BRAIDS |
| 10C | TAB | 32B | BRAIDS |
| 12 | HOOK | 32C | BRAIDS |
| 12A | PRONG PARTITION HOOK | 34 | UNBRAIDED HAIR |
| 12B | GAP PARTITION HOOK | 36 | INDEX FINGER |
| 12C | CUTOUT | 38 | HAIR END |
| 14 | PRONGS | 40 | PRONG PARTITION |
| 14C | PRONGS | 42 | GAP PARTITION |

-continued

| | | | |
|---|---|---|---|
| 18 | LONGITUDINAL AXIS | 44 | NUT |
| 18C | LONGITUDINAL AXIS | 46 | BOLT |
| 20 | STRAP MATERIAL | 48 | LOCK WASHER |
| 20C | STRAP MATERIAL | 50 | LEFT HAND |

SUMMARY

As used herein a definition of a finger shall include a thumb. A braid removal tool comprising a comb and a strap to fasten the comb to at least one finger of a user's hand. A method of removing braids with the tool.

DESCRIPTION OF INVENTION

Figure 1:
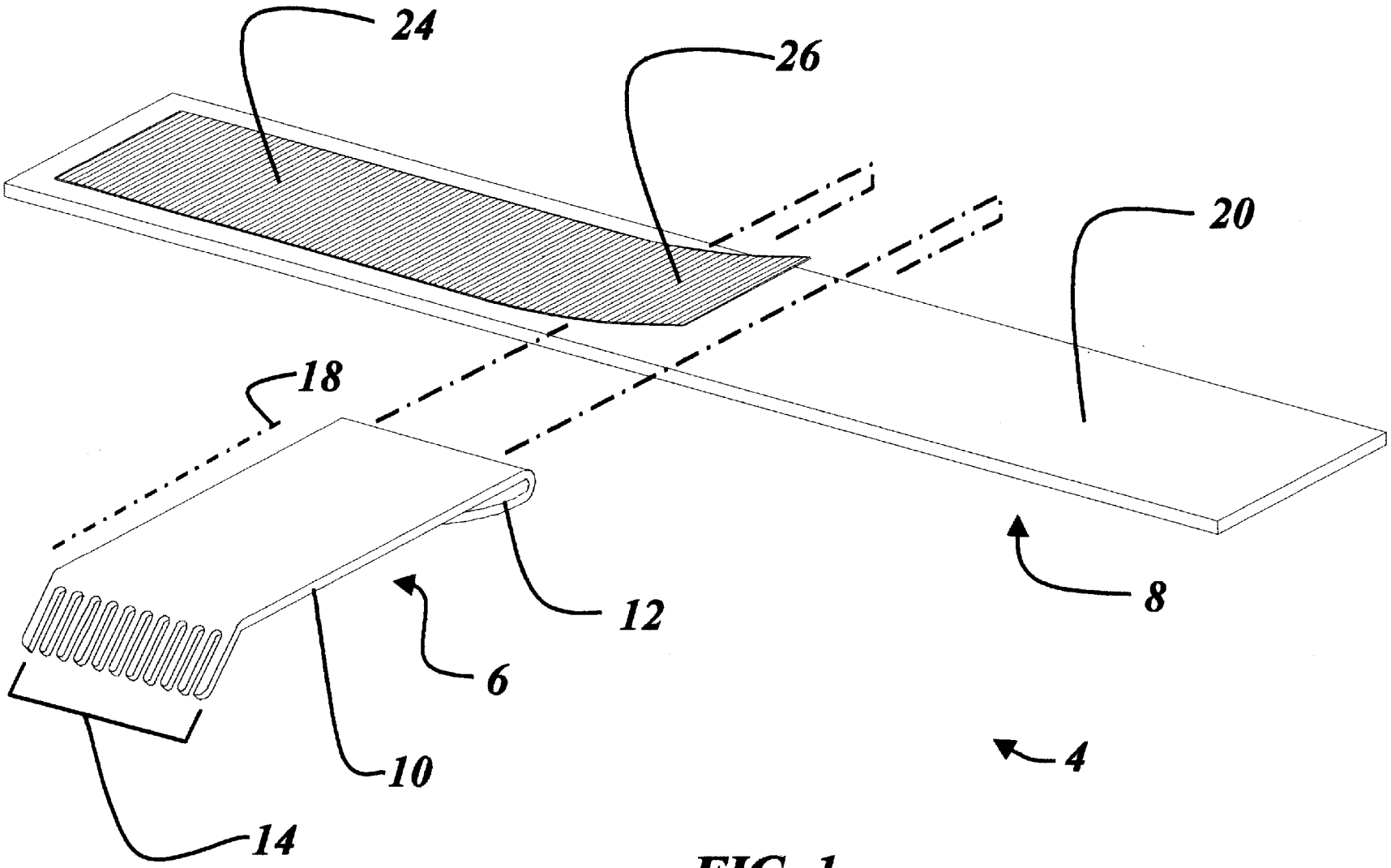
FIGS. 1 & 2 show various exploded views of a braid removal tool.
Figure 2:
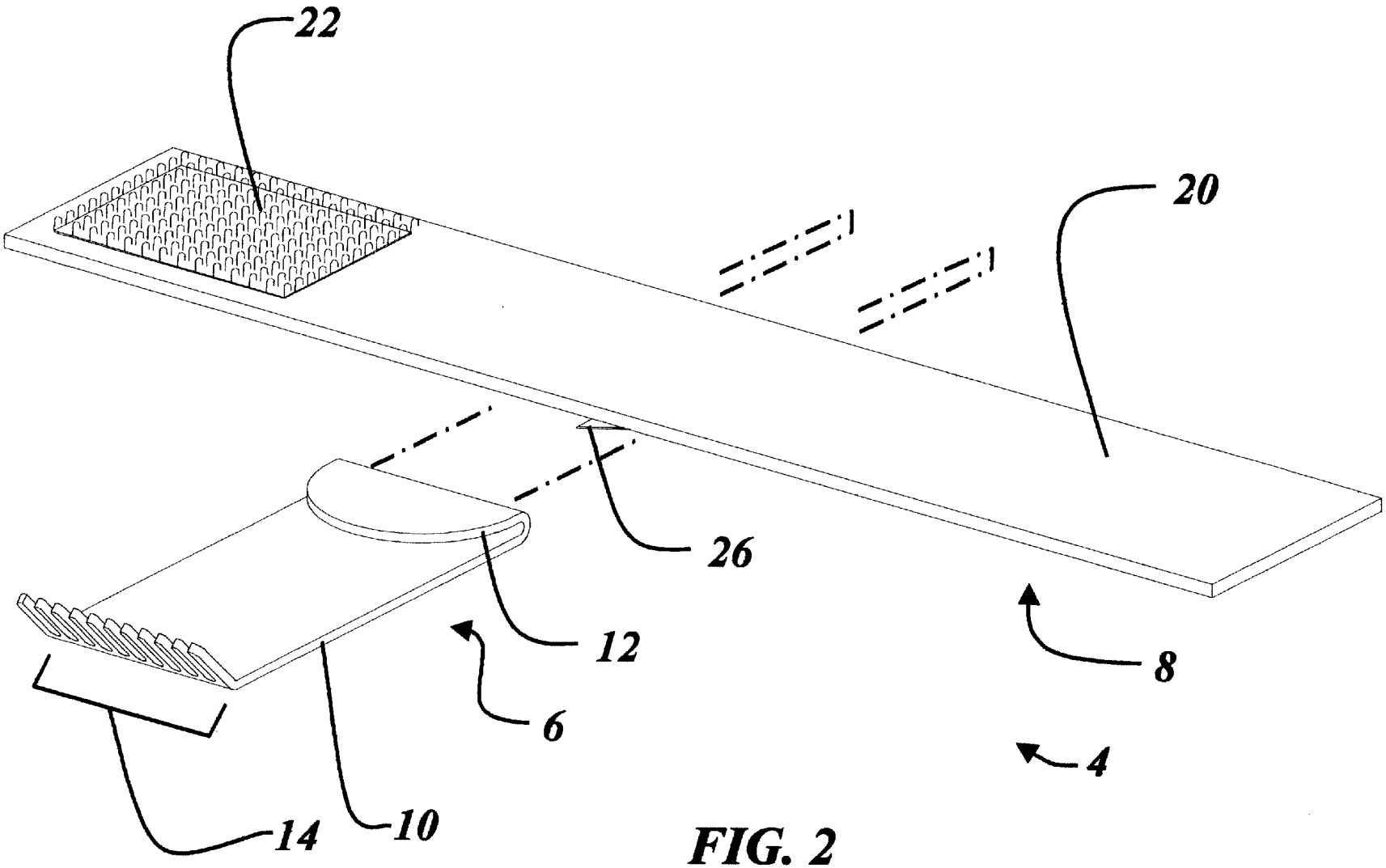

FIGS. 1 and 2 show top and bottom isometric, exploded views of a braid removal tool 4, a first embodiment of the present invention. The main parts of braid removal tool 4 include a comb 6 and a strap 8. Comb 6 comprises of a tab 10 with an integral hook 12 and an integral plurality of prongs 14. Prongs 14 are generally arranged at an angle measured from a longitudinal axis 18 of tab 10. Prongs 14 are angled in order to allow prongs 14 to easily disengage from a braid if an excessive combing force is used. A purpose of tab 10 is to provide a structure for resting a thumb of a user on comb 6. Strap 8 comprises of strap material 20 covered by a hook material 22 and a loop material 24. The purpose of strap 8 is to fasten comb 6 the thumb of the user. A flap 26 is an unfastened extension of loop material 24. The purpose of flap 26 is to cushion the thumb from tab 10. Tab 10 is sandwiched between flap 26 and strap material 20 with hook 12 hooked to strap material 20. To fasten tool 4 to thumb using strap 8, first position thumb against tab 10 with flap 26 sandwiched between thumb and tab 10 and with longitudinal axis 18 generally parallel to thumb. Wrap strap material 20 over thumb. Finally, attach hook material 22 to loop material 24 to maintain strap 8 in a wrapped position.

Figure 3:
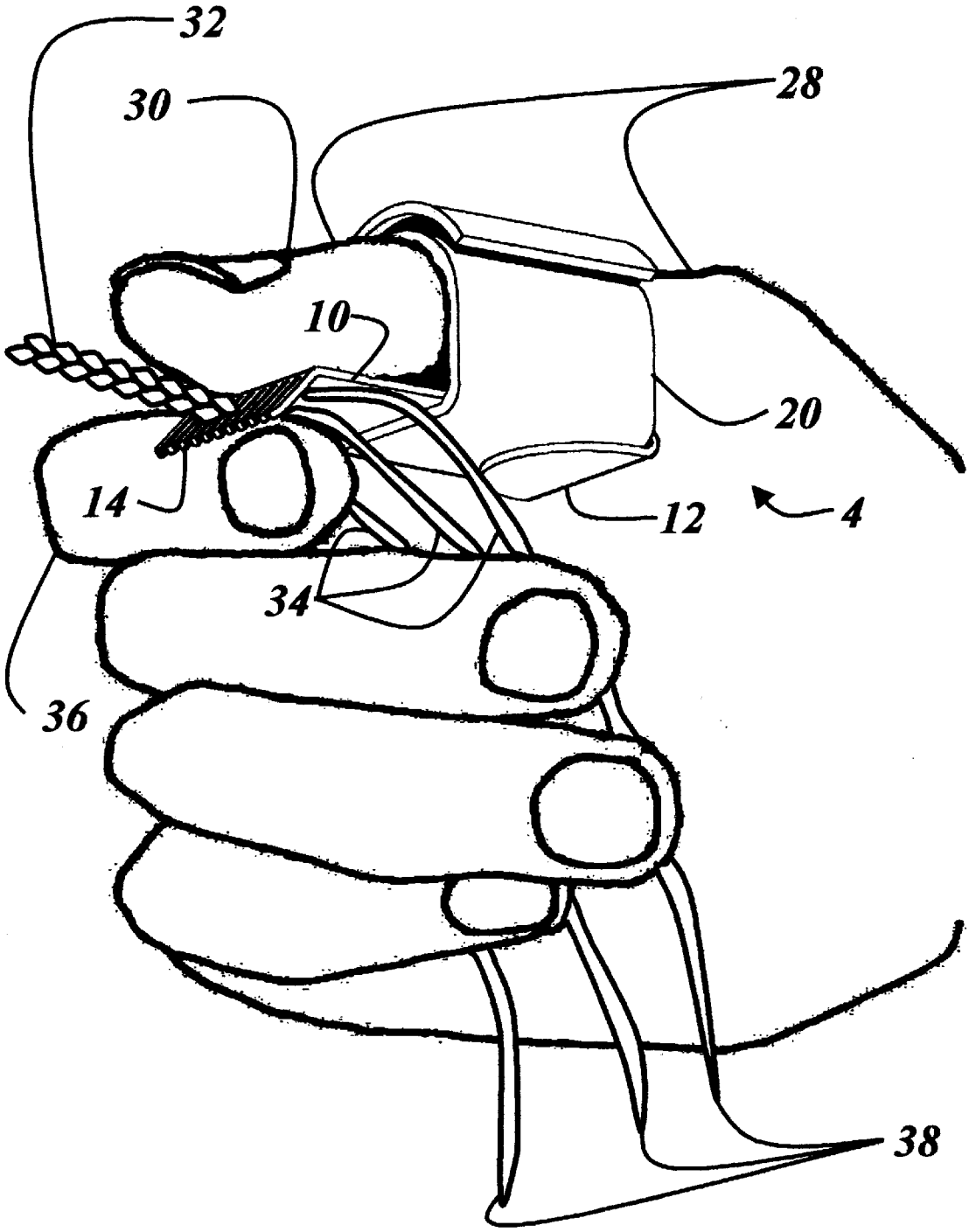
FIG. 3 shows the braid removal tool used to remove braids.

FIG. 3 shows braid removal tool 4 used to remove a section of braids 32. To remove braids 32 first engage prongs 14 with braids 32 by grasping a section of unbraided hair 34 between an index finger 36 and tab 10. Once the prongs are engaged with braids 32 use a downward motion and comb braids 32 toward a hair end 38. Repeat this procedure until braids 32 are completely removed. Although a single set of braids 32 is shown in FIG. 3, tool 4 can be engaged with multiple sets of braids simultaneously. Although a three-stranded braid style is shown in FIG. 3, tool 4 can be used with other styles of intertwined hair. Although the tool 4 is shown fastened to thumb 30, tool 4 can be fastened to one, two, three or four adjacent fingers of a hand of the user with minor modifications.

Figure 4:
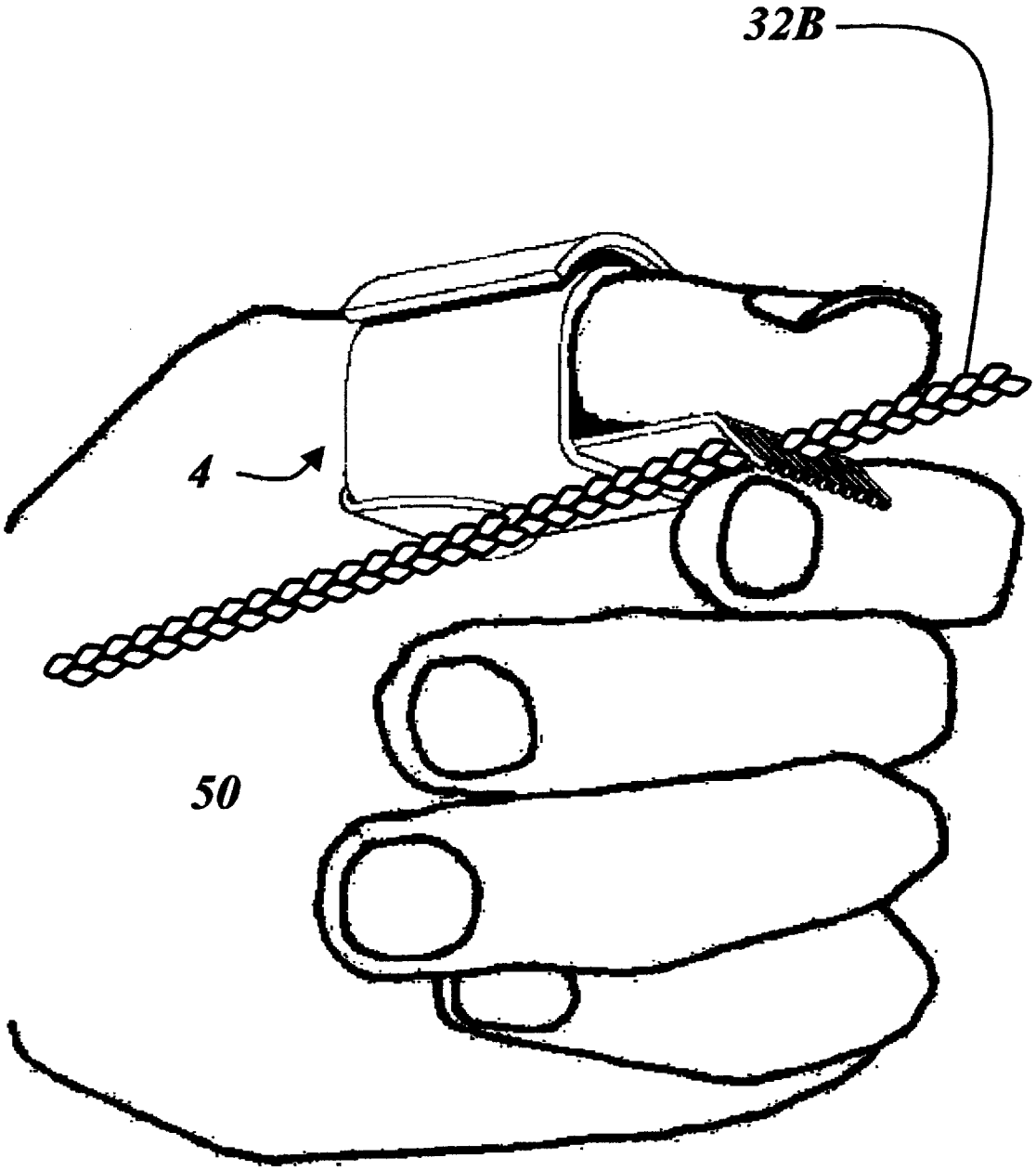
FIG. 4 shows the braid removal tool used to grip braids.

FIG. 4 shows braid removal tool 4 used to assist a left hand 50 to grasp the braids 32B to prevent excessive pulling force on a scalp. Depending on the user's preference, the tool could also be used to assist a right hand to grasp the braids.

Figure 5:
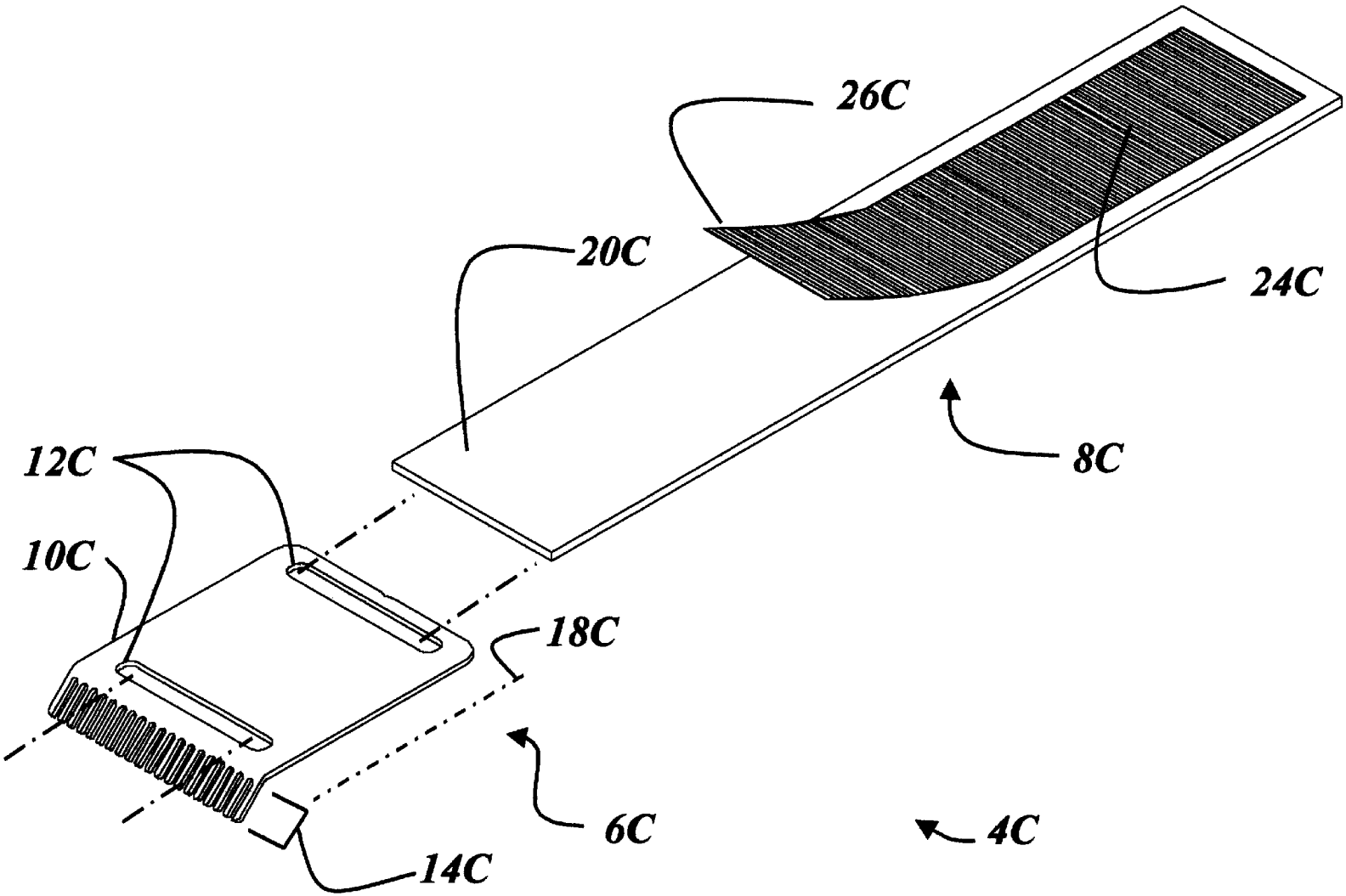
FIGS. 5 & 6 show various exploded views of a variation of the braid removal tool.
Figure 6:
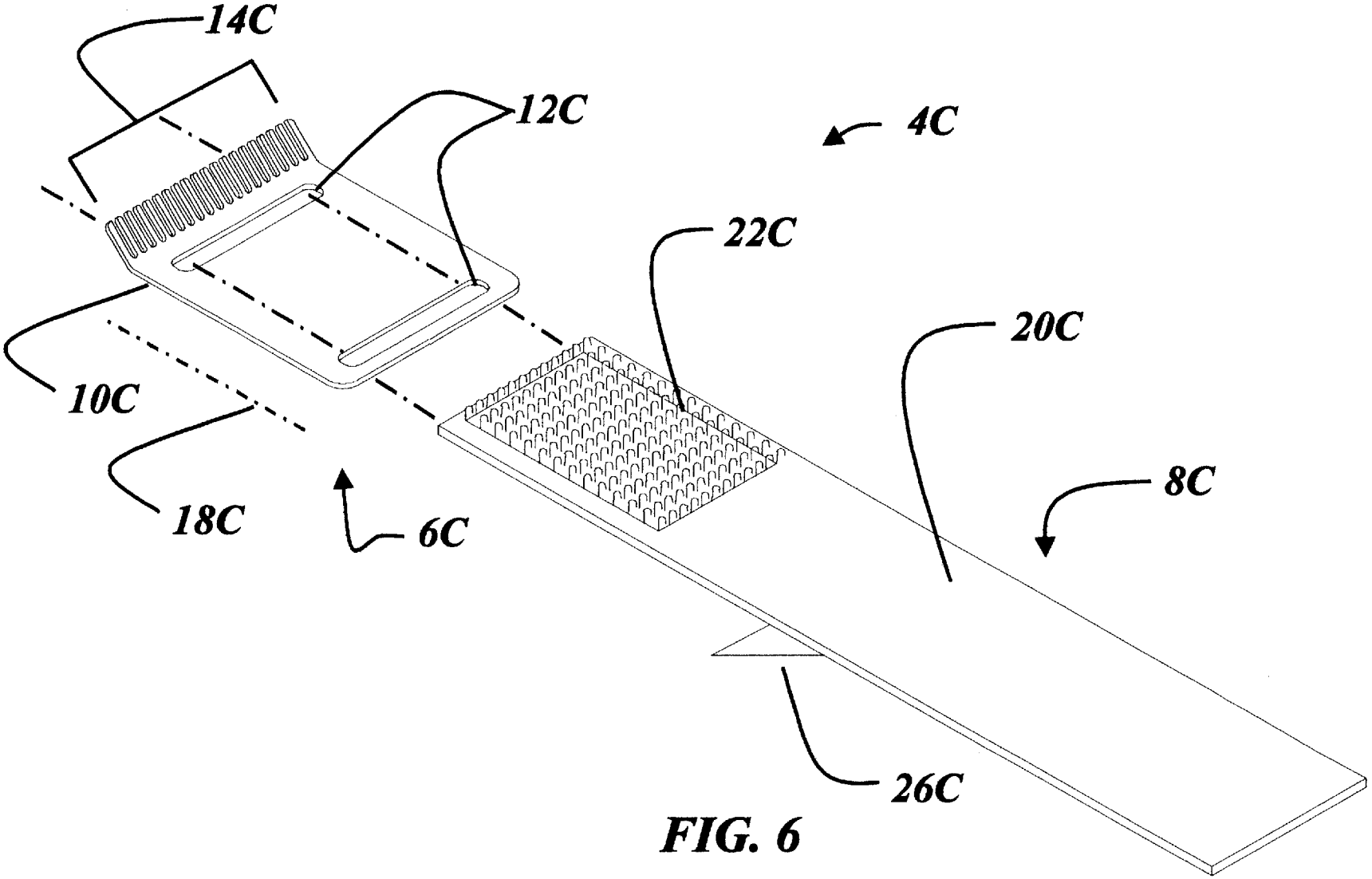

FIGS. 5 and 6 shows top and bottom isometric, exploded views of a braid removal tool 4C, a second embodiment of the present invention. The main parts of braid removal tool 4C include a comb 6C and a strap 8C. Comb 6C comprises a tab 10C with a pair of parallel cutouts 12C and an integral plurality of prongs 14C. Prongs 14C are generally arranged at an angle measured from a longitudinal axis 18C of tab 10C. Strap 8C comprises of strap material 20C covered by a hook material 22C and a loop material 24C. The purpose of strap 8C is to fasten comb 6C a pair of fingers of the user's hand. A flap 26C is an unfastened extension of loop material 24C. Tab 10C is sandwiched between flap 26C and strap material 20C with strap passing through pair of cutouts 12C. To fasten tool 4C to a pair of fingers using strap 8C, first position fingers against tab 10C with flap 26C sandwiched between fingers and tab 10C and with longitudinal axis 18C generally perpendicular to fingers. Wrap strap material 20C over fingers. Finally, attach hook material 22C to loop material 24C to maintain strap 8C in a wrapped position.

Figure 7:
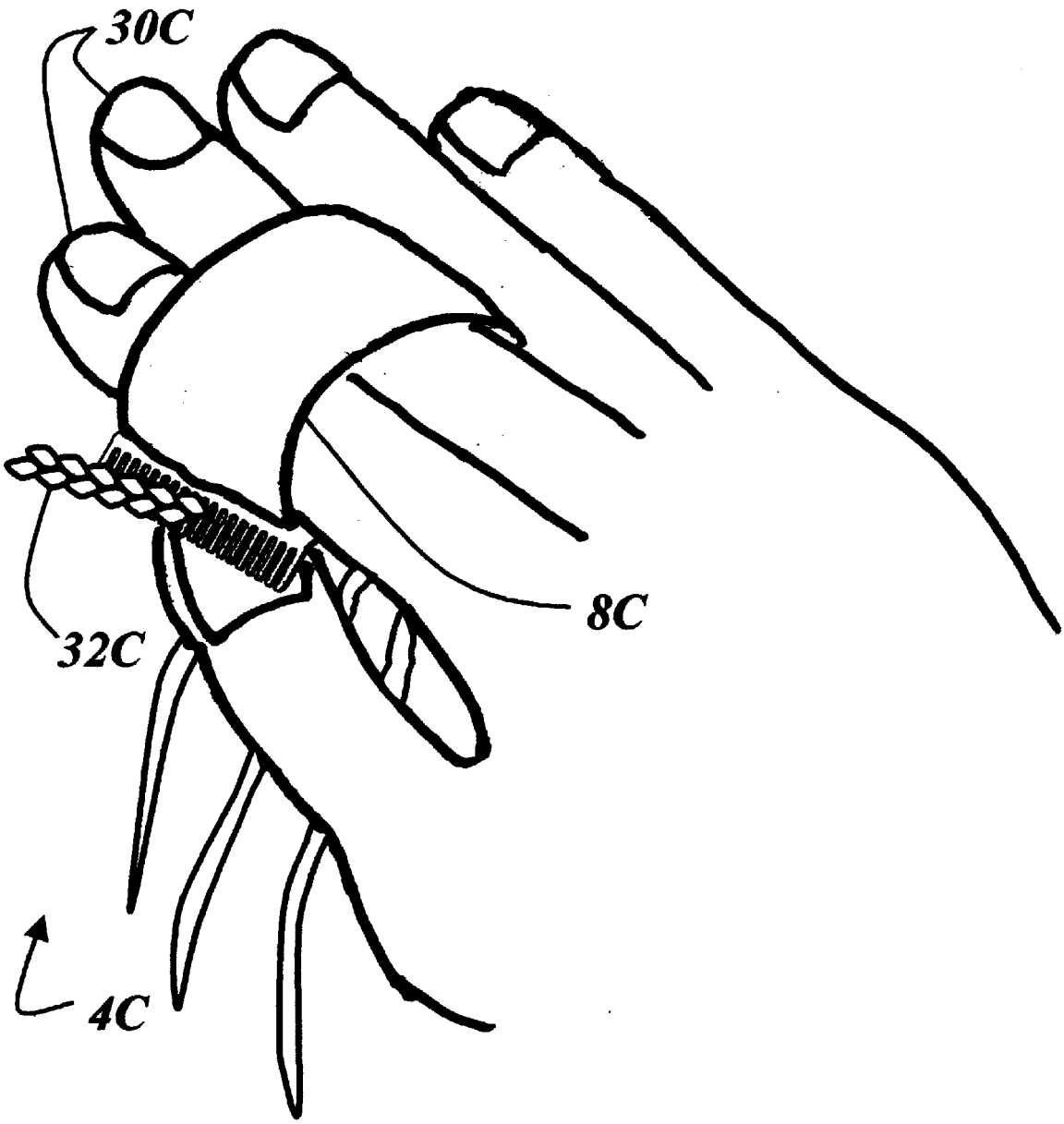
FIG. 7 shows the variation of the braid removal tool used to remove braids.

FIG. 7 shows braid removal tool 4C used to remove braids 32C. Although the tool 4C is shown fastened to two fingers 30C of the user's hand, tool 4 can be fastened to three or four adjacent fingers, or to a single finger, including the thumb, of the user's hand with minor modifications.

Figure 8:
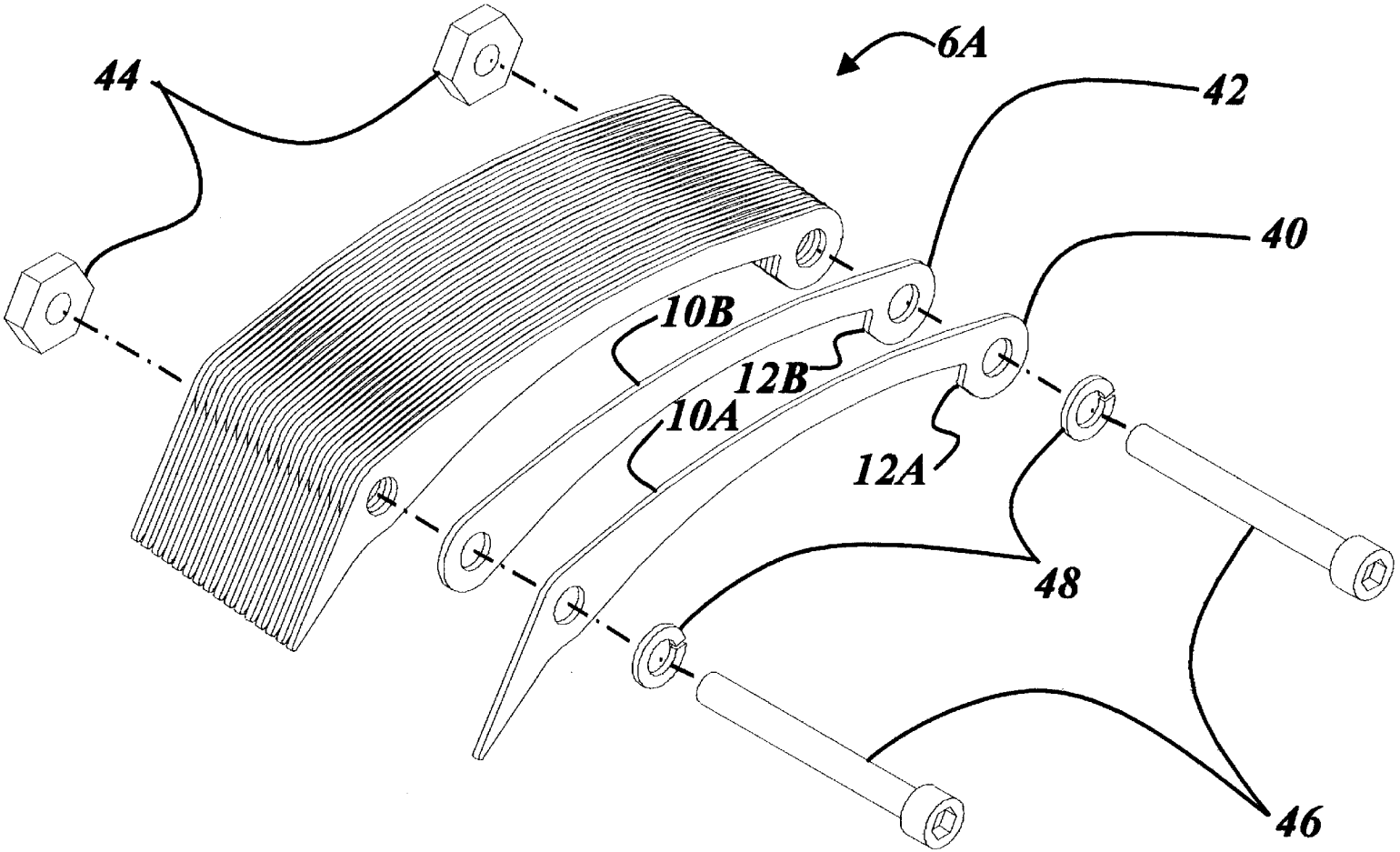
FIG. 8 shows an exploded view of another variation of the braid removal tool.

FIG. 8 shows a third embodiment of the present invention. The third embodiment comprises a partitioned comb 6A. Partitioned comb 6A comprises of a multiplicity of prong partitions 40 and gap partitions 42. Partitions 40 and 42 are alternatively arranged and are fastened together by a pair of nuts 44 and a pair of bolts 48. A pair of lock washers 48 is used to prevent nut 44 and bolt 46 from becoming loosened. Prong partition 40 has a hook 12A and a tab 10A. Gap partition 42 has a hook 12B and a tab 10B. Hooks 12A and 12B have the same purpose as hook 12 (FIGS. 1, 2 and 3). Tabs 10A and 10B have the same purpose as tab 10 (FIGS. 1, 2 and 3). By varying a number of gap sections 42 between adjacent prong sections 40 a distance between the adjacent prong sections 40 can be modified. Therefore, sections 40 and 42 can be used to construct various sized partitioned combs to be used with various sized braids. Although not show, a strap similar to strap 8 (FIGS. 1 and 2) or strap 8C (FIGS. 5 and 6) previously described can be used to fasten comb 6A to at least one finger of the user's hand. Although the illustration shows nuts 44 and bolts 48 used to fasten the partitions 40 and 42 together, welding, melding, gluing, riveting, stapling, press-fitting, pinning, in-situ injection molding and other fastening methods can be used.

For the first and second embodiments (FIGS. 1, 2, 5, and 6), a preferred comb 6 or 6C material is stainless steel. However, other suitable materials such as plastic or wood can be used. Comb 6 or 6C made of stainless steel can be manufactured using conventional photochemical etching and/or metal stamping processes. Preferably, length of prongs 14 or 14C is shorter than prongs on a conventional comb to allow for fast disengagement of prongs 14 or 14C from braids during repeated combing in a braided hair removal process. Prongs 14 or 14C can be arranged at an angle of 5° to 90° measured from the longitudinal axis 18 or 18C of tab 10 or 10C. Preferably, the prongs 14 or 14C are arranged at an angle of 45°. Strap material 20 or 20C is preferably made of a fabric or other flexible sheet-like material. Hook material 22 or 22C and loop material 24 or 24C can be glued, welded or sewn to strap material 20 or 20C. As shown in FIG. 3, when the comb 6 is fastened to thumb 30, a preferred width of strap material 20 is approximately equal to the distance between a pair of knuckles 28 of thumb 30.

Variations of the first embodiment (FIGS. 1 and 2) could include strap 8 substantially attached or fastened to comb 6 using hook and loop material, or permanently fastened thereto using gluing, riveting, stapling, pinning, or in-situ injection molding. Also, an embodiment is possible where strap 8 passes through at least one cutout in tab 10, eliminating the need for hook 12. Although the illustrations show the width of plurality of prongs 14 to be approximately equal to the width of tab 10, another embodiment could include the width of plurality of prongs 14 to be wider or narrower than the width of tab 10. Although a plurality of prongs 14 is shown it is possible to have a comb 6 with a single prong.

Variations of the second embodiment (FIGS. 5 and 6) could include strap 8C substantially attached or fastened to comb 6C using hook and loop material, or permanently fastened thereto using gluing, riveting, stapling, pinning, or in-situ injection molding. Also, an embodiment is possible where strap 8C has a pair of slots perpendicular to the longitudinal axis 18C to receive a hook extending from comb 6C. Although the illustrations show the width of plurality of prongs 14C to be approximately equal to the width of tab 10C, another embodiment could include the width of plurality of prongs 14C to be wider or narrower than the width of tab 10C. Although a plurality of prongs 14C is shown it is possible to have a comb 6C with a single prong.

Alternatively the strap can be used to tie the comb to at least one of the fingers, eliminating the need for the hook and loop material on the strap. Alternatively, the strap as an elastic loop can be used to fasten the comb to at least one of the fingers, eliminating the need for the hook and loop material on the strap.

For the third embodiment (FIG. 8), a preferred partition material is stainless steel. However, other suitable materials such as plastic or wood can be used. Partitions made of stainless steel can be manufactured using conventional photochemical etching and/or metal stamping processes.

Variations of the third embodiment could include strap 8 (FIGS. 1 and 2) substantially attached or fastened to comb 6A using hook and loop material, or permanently fastened thereto using gluing, riveting, stapling, pinning, or in-situ injection molding. Also, an embodiment is possible where strap 8 passes through cutouts in partitions 40 and 42, eliminating the need for hooks 12A and 12B. Although a multiplicity of prongs sections 40 is shown it is possible to have a comb 6A with a single prong section. Although the partitions 40 and 42 are alternatively spaced, it is possible to put more than one gap partition 42 between adjacent prong partitions 40. Likewise, it is possible to put more than one prong partition 40 between adjacent gap partitions 42. Gap partitions 42 may also be replaced by a pair of washers. Hence a space is formed between adjacent prong partitions 42 through which strap 8 may pass.

CONCLUSION AND SCOPE OF INVENTION

Thus the reader will see that my braid removal tool has a number of advantages providing a safe, easy-to-use, fast, inexpensive device which can be used by individuals to remove braids from their own hair or from the hair of others:

a) Multiple sets of braids can be removed simultaneously.
b) Only a single hand is required to engage the tool and braids.
c) Sight of the tool and braids is not required allowing an individual to more easily remove his or her own braids.
d) Numbness and cramps in the fingers and damage to fingernails are eliminated because they are not used to directly remove the braids.
e) Less post braid removal combing is required because combing will be performed during the braid removal process.
f) The typical time for removing braids is reduced.
g) Fatigue in the hand grasping the braid and the risk of pulling on the scalp is reduced.

While my above description contains many specificities, these should not be construed as limitations on the scope of the invention, but as an exemplification of one preferred embodiment thereof. Many other variations are possible.

What is claimed:

1. A braid removal tool comprising:

a) a comb having a tab and at least two prongs and a hook, said tab having a distal end and a proximal end defining longitudinal axis therebetween, said at least two prongs being at said proximal end; and said hook being at said distal end of said tab, said hook having a curved bend forming a space between said bend and said tab; and b) a strap engaged in said space of said hook, wherein said strap is for fastening said comb to at least one finger of a user's hand such that said longitudinal axis of said comb is substantially perpendicular or parallel with said at least one finger of said user's hand.

2. The braid removal tool of claim 1, wherein said strap has at least one slot to receive said hook wherein said hook is hooked to said slot such that said strap is further engaged with said tab of said comb.

3. A braid removal tool comprising:

a) a comb having a tab and at least one prong, said tab having a distal end and a proximal end defining a longitudinal axis therebetween, said at least one prong at said proximal end;

b) a strap engaged substantially perpendicular or parallel with said tab of said comb along said longitudinal axis, wherein said strap is for fastening said comb to at least one finger of a user's hand such that said longitudinal axis of said comb is respectively substantially parallel or perpendicular to said at least one finger of said user's hand; and c) wherein said comb further comprises at least one cutout in said tab, said at least one cutout is substantially parallel to said longitudinal axis, and said strap is passed through said at least one cutout whereby said strap is further engaged with said tab of said comb.

4. A braid removal tool comprising:

a) a comb having a tab and at least one prong, said tab having a distal end and a proximal end defining a longitudinal axis therebetween, said at least one prong at said proximal end;

b) a strap engaged substantially perpendicular or parallel with said tab of said comb along said longitudinal axis, wherein said strap is for fastening said comb to at least one finger of a user's hand such that said longitudinal axis of said comb is respectively substantially parallel or perpendicular to said at least one finger of said user's hand; and c) wherein said comb further comprises at least one cutout in said tab, said at least one cutout is substantially perpendicular to said longitudinal axis, and said strap is passed through said at least one cutout whereby said strap is further engaged with said tab of said comb.

5. The braid removal tool of claim 1, further comprising:

a) a hook material covering a portion of a bottom surface of said strap and a loop material covering a portion of a top surface of said strap wherein said hook material is attached to said loop material after the strap is wrapped over said at least one finger whereby said strap is maintained in a wrapped position.

6. The braid removal tool of claim 2, further comprising:

a) a hook material covering a portion of a bottom surface of said strap and a loop material covering a portion of a top surface of said strap wherein said hook material is attached to said loop material after the strap is wrapped over said at least one finger whereby said strap is maintained in a wrapped position.

7. The braid removal tool of claim 3, further comprising:

a) a hook material covering a portion of a bottom surface of said strap and a loop material covering a portion of a top surface of said strap wherein said hook material is attached to said loop material after the strap is wrapped over said at least one finger whereby said strap is maintained in a wrapped portion.

8. The braid removal tool of claim 4, further comprising:

a) a hook material covering a portion of a bottom surface of said strap and a loop material covering a portion of a top surface of said strap wherein said hook material is attached to said loop material after the strap is wrapped over said at least one finger whereby said strap is maintained in a wrapped position.

9. The braid removal tool of claim 1, wherein said strap is an elastic loop.

10. The braid removal tool of claim 2, wherein said strap is an elastic loop.

11. The braid removal tool of claim 3, wherein said strap is an elastic loop.

12. The braid removal tool of claim 4, wherein said strap is an elastic loop.

13. The braid removal tool of claim 5, further comprising:

a) a flap extending from said loop material wherein said tab is sandwiched between said flap and said strap whereby the at least one wrapped finger is cushioned from said tab.

14. The braid removal tool of claim 1, wherein said comb comprises of a multiplicity of prong and gap sections, said sections are generally alternatively arranged and fastened together.

15. The braid removal tool of claim 1, wherein said at least one prong is angled from said longitudinal axis of said tab.

16. A braid removal tool comprising:

a) a comb having a tab and at least one prong, said tab having a distal end and a proximal end defining a longitudinal axis therebetween, said at least one prong at said proximal end;

b) a strap engaged substantially perpendicular or parallel with said tab of said comb along said longitudinal axis, wherein said strap is for fastening said comb to at least one finger of a user's hand such that said longitudinal axis of said comb is respectively substantially parallel or perpendicular to said at least one finger of said user's hand; and c) said strap is permanently attached to said comb.

17. A method of removing braids from hair comprising:

a) fastening a braid removal tool to a user's thumb by said braid removal tool comprising a comb having a tab and at least one prong, said tab having a distal end and a proximal end defining a longitudinal axis therebetween, said at least one prong at said proximal end; add a strap engaged substantially perpendicular with said tab of said comb along said longitudinal axis, wherein said strap is for fastening said comb to said thumb such that said longitudinal axis of said comb is substantially parallel to said thumb;

b) grasping a section of unbraided hair between a user's index finger and said tab of said braid removal tool;

c) engaging said prongs of said braid removal tool with the braids; and d) combing braids towards an end of hair.

18. A method of removing braids from hair comprising:

a) fastening a braid removal tool to at least one finger (not including a thumb) of a user's hand, said braid removal tool comprising a comb having a tab and at least one prong, said tab having a distal end and a proximal end defining longitudinal axis therebetween, said at least one prong at said proximal end; and a strap engaged substantially parallel with said tab of said comb a long said longitudinal axis, wherein said strap is for fastening said comb to said at least one finger (not including a thumb) such that said longitudinal axis of said comb is substantially perpendicular to said at least one finger (not including a thumb);

b) grasping as section of unbraided hair between said thumb and said tab of said braid removal tool;

c) engaging said prongs of said braid removal tool with the braids; and d) combing braids towards an end of hair.

* * * * *